US010578334B2

(12) United States Patent
Prihoda et al.

(10) Patent No.: US 10,578,334 B2
(45) Date of Patent: Mar. 3, 2020

(54) AIR DUCT WITH REGULATION MEMBRANE

(71) Applicant: PRIHODA s.r.o., Hlinsko (CZ)

(72) Inventors: Zdenek Prihoda, Hlinsko (CZ); Michal Bures, Hlinsko (CZ)

(73) Assignee: Prihoda s.r.o., Hlinsko (CZ)

( * ) Notice: Subject to any disclaimer, the term of this patent is extended or adjusted under 35 U.S.C. 154(b) by 273 days.

(21) Appl. No.: 15/556,641

(22) PCT Filed: Mar. 8, 2016

(86) PCT No.: PCT/CZ2016/000025

§ 371 (c)(1),
(2) Date: Sep. 8, 2017

(87) PCT Pub. No.: WO2016/141901

PCT Pub. Date: Sep. 15, 2016

(65) Prior Publication Data

US 2018/0058714 A1 Mar. 1, 2018

(30) Foreign Application Priority Data

Mar. 9, 2015 (CZ) ..... 2015-164
Jul. 7, 2015 (CZ) ..... 2015-470

(51) Int. Cl.
*F24F 13/02* (2006.01)
*F24F 13/065* (2006.01)
*F24F 13/10* (2006.01)

(52) U.S. Cl.
CPC ..... *F24F 13/0218* (2013.01); *F24F 13/0281* (2013.01); *F24F 13/065* (2013.01); *F24F 13/105* (2013.01)

(58) Field of Classification Search
CPC ..... F24F 13/0218; F24F 11/0001; F24F 13/0281; F24F 13/105; F24F 13/10
(Continued)

(56) References Cited

U.S. PATENT DOCUMENTS 5,111,739 A 5/1992 Hall
2007/0197159 A1* 8/2007 Byczynski ..... F24F 11/0001 454/340

FOREIGN PATENT DOCUMENTS

EP 2492606 A1 8/2012
EP 2578957 A1 4/2013
WO 2010039100 A1 4/2010

OTHER PUBLICATIONS

International Searching Authority, Written Opinion and Search Report issued in International Application No. PCT/CZ2016/000025 dated Sep. 9, 2016 (9 pages).

* cited by examiner

*Primary Examiner* — Vivek K Shirsat
*Assistant Examiner* — Ko-Wei Lin
(74) *Attorney, Agent, or Firm* — Wood Herron & Evans LLP

(57) ABSTRACT

An air-conditioning duct comprises a regulating membrane attached to a peripheral wall of the duct and a shifting element. The membrane has a first end that is attached to the shifting element and faces an inlet for supplying air. An area of the membrane comprising said first end is adapted for being selectively shifted to a first or second portion of the peripheral wall. The shifting element is for shifting the first end of the membrane to the first or second portion of the peripheral wall. The membrane has a second end, which faces away from the inlet of the duct, secured inside the duct to ensure that shifting of the area of the first end of the membrane to the second portion of the peripheral wall prevents the air flow from passing through that portion of the duct situated downstream of the attached second end of the membrane.

16 Claims, 7 Drawing Sheets

(58) Field of Classification Search
USPC ..... 454/237–238, 241, 333
See application file for complete search history.

Fig. 3
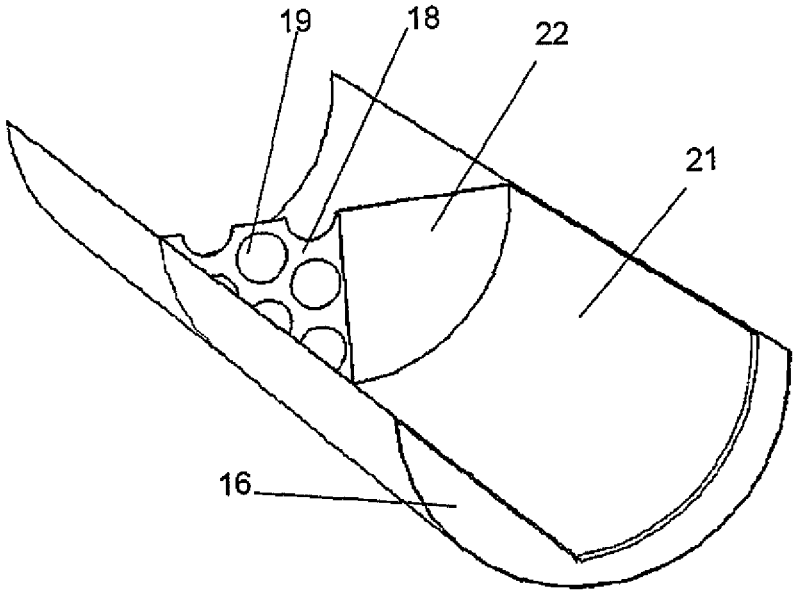
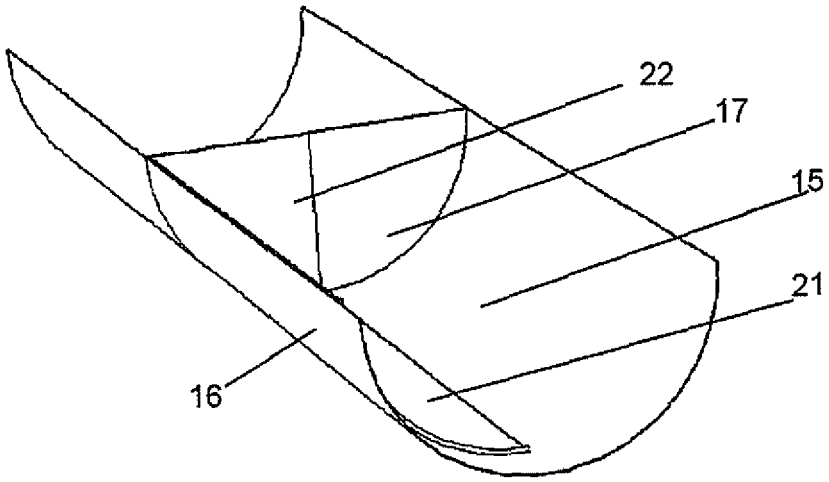
Fig. 4

AIR DUCT WITH REGULATION MEMBRANE

CROSS-REFERENCE TO RELATED APPLICATIONS

This application is a Section 371 national phase application of International Application No. PCT/CZ2016/000025, filed on Mar. 8, 2016, which claims priority to Czech Republic Application Nos. PV 2015-470, filed on Jul. 7, 2015, and PV 2015-164, filed on Mar. 9, 2015, the disclosures of which are incorporated by reference herein in their entireties.

FIELD OF ART

The present invention relates to an air-conditioning duct for distributing air, comprising a peripheral wall having a first part and a second portion, which meet each other along two lines, an inlet for supplying air, a regulating membrane made of air impermeable woven or non-woven fabric or of a foil, which membrane comprises a longitudinal portion arranged inside the air-conditioning duct and attached to the peripheral wall of the same along the line dividing between the first portion and the second portion, the regulating membrane being adapted for being selectively shifted to the first portion or the second portion of the peripheral wall of the duct, and a shifting element for shifting the regulating membrane to the first portion or the second portion of the peripheral wall of the duct, the regulating membrane being attached to the shifting element with its end region, which is facing the inlet for supplying air.

BACKGROUND ART

Known air conditioning ducts for distributing air, which are made of a woven or non-woven fabric and which are also referred to as textile ducting outlets, typically consist of a material sewn together so as to form a closed shape having a specific cross section (ducting elements). The wall of a duct may be perforated or provided with through holes, the air distribution taking place through such perforation or holes. Distributing air in a proper manner is one of the most important functions of an air conditioning distribution system.

In certain cases, it is required that the direction of the distributed air flow is selectable between the downward one and the upward one, i.e. towards a ceiling, without necessitating the adjustment of the respective ducting element to be too complex. For this purpose, a ducting outlet combining two outlet types into one has been developed (FIG. 1). A membrane, which is made of a lightweight impervious fabric, is horizontally sewed into the centre of the ducting outlet. It alternately covers the first half or the second half of the ducting outlet. The front-end part of the membrane is attached to a shifting element actuated by a servomotor. Owing to this arrangement, two different positions may be selected, mostly a cooling position and a heating one. When assuming the heating position, the membrane overlaps the upper half of the ducting outlet, thus enabling air to exit through an array of holes in a downward direction. When assuming the cooling position, the membrane overlaps the lower half of the ducting outlet, thus enabling air to exit through a fabric or micro-perforation, the direction of the exiting air flow being limited to the upward one.

Furthermore, air-conditioning ducts having their longitudinal axes oriented in the vertical direction are known. In certain cases, the operation of such ducts is connected with requirements for getting the direction of the outlet air flow by means of a regulating membrane.

Moreover, known ducting elements are occasionally required to be temporarily fully closable. For example, various mechanisms made of metal materials and installed at the inlet end of the duct are used for this purpose. The material of such mechanisms causes a considerable increase in the overall weight on the one hand, and does not enable such closing mechanisms to be machine washed.

A shifting element according to the prior art substantially follows one half of the circumference of the cross section of the duct which means that it usually has a semi-circular shape. Thus, shifting of the element from one position to the other is carried out by turning the same by 180°. The drawbacks of the aforesaid technical solution consist in that the shifting action takes a relatively long time during which the membrane is subject to the highest strains (waving motion in an air flow) so that it becomes prone to be damaged. Moreover, a driving motor for turning the above mentioned element by 180° is relatively heavy, thus increasing the overall structural weight of the air-conditioning duct.

SUMMARY OF THE INVENTION

The above mentioned drawbacks of the prior art are eliminated by the air-conditioning duct having the features as defined in claim 1.

The drawbacks of the prior art are also eliminated by an air-conditioning duct for conveying and/or distributing air, comprising a peripheral wall, an inlet for supplying air, a regulating membrane made of air impermeable woven or non-woven fabric or of a foil, which membrane comprises a longitudinal portion arranged inside the air-conditioning duct and attached to the peripheral wall of the same along at least one line dividing the peripheral wall of the duct into a first portion and a second portion, the regulating membrane being at least in its first end area adapted for being selectively shifted to the first portion or the second portion of the peripheral wall of the duct, and a shifting element for shifting an end of the regulating membrane to the first portion or the second portion of the peripheral wall of the duct, the regulating membrane having its first end attached to the shifting element and the shifting element having a shape corresponding to one half of the circumference of an oblique section through the air-conditioning duct, said section extending along a plane forming an angle between 30 and 80° with the longitudinal axis of the duct.

The shifting element for shifting the regulating membrane to the first portion or second portion of the peripheral wall of the duct is arranged inside the air-conditioning duct in a manner allowing the same to be turned preferably at an angle ranging between 70 and 120°, more preferably at an angle ranging between 80 and 110°, most preferably at an angle of 90°.

According to a preferred embodiment, the shifting element has a shape corresponding to one half of the circumference of an oblique section through the air-conditioning duct, said section extending along a plane forming an angle, which is equal to one half of the turning angle of the shifting element, with the longitudinal axis of the duct.

Furthermore, the above mentioned drawbacks of the prior art are also eliminated by an air-conditioning duct for conveying and/or distributing air, comprising a peripheral wall, an inlet for supplying air, and a regulating membrane made of air impermeable woven or non-woven fabric or of a foil, which membrane comprises a longitudinal portion arranged inside the air-conditioning duct and attached to the peripheral wall of the same along two lines extending in the longitudinal direction and dividing the peripheral wall of the duct into a first portion and a second portion, the regulating membrane being at least in its first end area, which faces the inlet of the duct, adapted for being selectively shifted to the first portion or the second portion of the peripheral wall of the duct, an interior partition made of a woven or non-woven fabric or of a foil and attached to the peripheral wall of the duct, thereby partitioning at least a part of the inside cross section, the regulating membrane having its end, which faces away from the inlet of the duct, attached to the interior transverse partition, the area of the interior partition confined between the regulating membrane and the first portion of the peripheral wall being impervious and the remaining area of the inside cross section of the duct at the level of the interior partition being adapted for allowing air to flow therethrough.

Preferably, the attachment line between the regulating membrane and the interior partition corresponds to the line between the impervious area and the pervious area.

According to a specific preferred embodiment the first portion of the peripheral wall is pervious and/or provided with a perforation and/or with through holes and when the regulating membrane overlaps the first portion of the peripheral wall, it also overlaps the impervious area of the interior partition. Such a duct preferably comprises also an outer jacket that surrounds the peripheral wall of at least a part of the duct, while being spaced apart from said peripheral wall, thus forming a chamber into which the holes of the first portion of the peripheral wall open, the outer jacket being provided with holes for distributing air into the surroundings. Such a duct may also comprise an end wall that is attached to the end of the duct facing away from the inlet end, the end wall extending along the interior partition spaced apart therefrom and being pervious and/or perforated and/or provided with through holes. Further, such a duct may preferably comprise a funnel-shaped wall having its narrower end attached to the peripheral wall and its wider end attached to the end wall and/or to the outer jacket, the funnel-shaped wall dividing the space extending between the outer jacket and the peripheral wall of the duct into a first partial space, into which the holes of the first portion of the peripheral wall open, and a second partial space, into which the air outlet for the air passing through the pervious area of the interior partition opens.

In some cases it may be also advantageous to make the regulating membrane such that it further comprises a transverse portion having a shape that corresponds to one half of the inside cross section of the duct, the regulating membrane being attached to the interior partition, particularly to the impervious area thereof, by means of said transverse portion.

It may be also advantageous, especially when the membrane is used for closing the duct, to make the duct at least partially, gradually widened, especially funnelled, namely in the area of the shifting element and in the adjoining areas.

BRIEF DESCRIPTION OF THE DRAWINGS

For more detail, the present invention will be further described with reference to exemplary embodiments and accompanying drawings.

FIG. 3 shows the duct of FIG. 2 in a longitudinal sectional view.

FIG. 4 shows the duct of FIG. 3 having its membrane shifted in the closed state.

DESCRIPTION OF EXEMPLARY EMBODIMENTS

Figure 1:
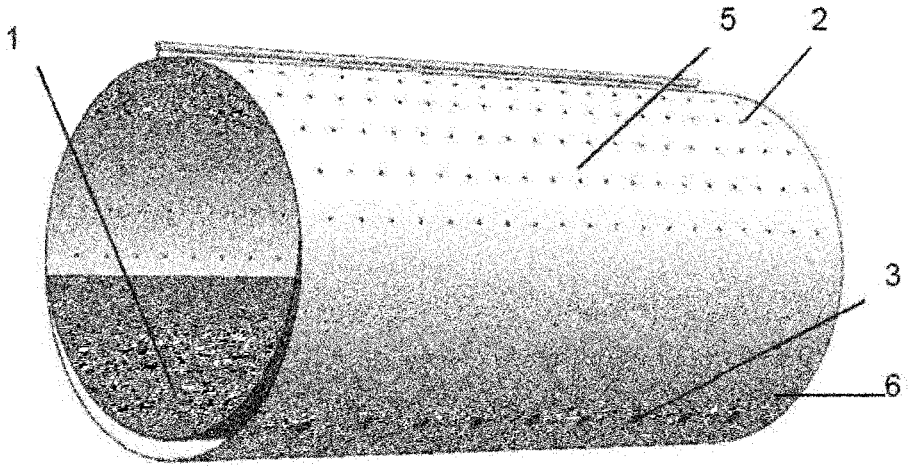
Prior Art Fig. 1
FIG. 1 shows an example of a prior art air-conditioning duct.

An example of a prior art air-conditioning duct comprising air impermeable regulating membrane 1 is shown in FIG. 1. This air-conditioning duct has a circular cross section, is made of a woven or non-woven fabric and is provided with an upper array of holes 2 and a lower array of holes 3 for distributing air.

The wall of such duct comprises a first portion 5 surrounding a first cross-sectional area of the air-conditioning duct and a second portion 6 surrounding a second cross-sectional area of the air-conditioning duct, the parting plane between the first portion 5 and the second portion 6 extending along the longitudinal direction of the duct, preferably along the longitudinal centre line of the same. Hereinafter, the latter plane is referred to as flip plane.

The aforesaid air-conditioning duct comprises an impervious regulating membrane 1 attached to the mutually opposite inner walls of the duct, each attachment line extending along the flip plane, namely along the transition line between the first portion 5 and the second portion 6.

The regulating membrane 1 is provided with a shifting device 40 (not shown in FIG. 1) facing towards the inlet side of the duct. The shifting device 40 incorporated in the duct shown in FIG. 1 can comprise a semi-circular hoop to which the adjoining end of the regulating membrane 1, on the one hand, and a servomotor, on the other hand, are attached, said servomotor serving for turning the semi-circular hoop both in an upward direction in order to cause the regulating membrane 1 to overlap the upper array of holes 2 (for distributing the air flow in a downward direction) and in a downward direction in order to cause the regulating membrane 1 to overlap the lower array of holes 3 (for distributing the air flow in an upward direction). However, the latter technical solution does not enable the duct to be closed and is not practically usable for ducts installed in a downward orientation.

The first exemplary embodiment of the present invention is described with reference to FIGS. 2 to 4. In this exemplary embodiment, the air-conditioning duct comprises a peripheral wall which includes a first portion 15 surrounding the respective first cross-sectional area and a second portion 16 surrounding the respective second cross-sectional area, the first portion 15 and the second portion 16 of the peripheral wall being mirror images of each other, the axis of symmetry thereof being defined by a flip plane extending in the lengthwise direction through the longitudinal centre line of the air-conditioning duct.

The duct comprises a transverse interior partition arranged therein, the partition having an impervious area 17 and a pervious area 18 allowing air to flow through it, the transition line between the impervious area 17 and the pervious area 18 of the interior partition extending substantially through the flip plane mentioned above.

In this exemplary embodiment, the pervious area 18 of the interior partition is provided with through holes 19. Another alternative, however, consists in providing a duct having an interior partition, which comprises merely the impervious area 17, while the remaining part of the inside cross section of such a duct remains entirely free; in other words, it is possible to create an impervious interior partition that protrudes merely into a certain part of the inside cross section of the duct, the remaining part of that cross section being left free. Alternatively, the pervious area 18 can be created from a pervious or perforated fabric or from a perforated foil.

The duct also comprises a regulating membrane arranged inside the same, said membrane consisting of a longitudinal portion 21 and a transverse portion 22.

The longitudinal portion 21 of the regulating membrane is sewed into the duct so that it substantially extends along the borders between the first portion 15 and the second portion 16 of the peripheral wall of the duct or along the lines defining the intersection between the above mentioned flip plane and the peripheral wall. In this exemplary embodiment, the longitudinal portion 21 of the regulating membrane is rectangular in shape and can be selectively shifted to, or preferably pushed against the first portion 15 or the second portion 16 of the peripheral wall when being subject to the action of flowing air.

In the vicinity of the inlet end of the duct, the longitudinal portion 21 is secured to a shifting element 42 of a shifting device 40 for shifting the regulating membrane to the first portion 15 or the second portion 16 of the peripheral wall.

The opposite end of the longitudinal portion 21 is connected to the transverse portion 22 of the regulating membrane, the transverse portion 22 having a shape that substantially corresponds to that of the impervious area 17 and/or to that of the pervious area 18 of the interior partition. Simultaneously, the transverse portion 22 of the regulating membrane is attached to/stitched on the interior partition along the transition line between the impervious area 17 and the pervious area 18 of the same.

In other words, the regulating membrane forms an interior wall inside the duct, the longitudinal portion 21 of said interior wall being adapted for adjoining the first portion 15 or the second portion 16 of the peripheral wall in a selective manner and the transverse portion 22 of said interior wall being adapted for adjoining the impervious area 17 or the pervious area 18.

In this exemplary embodiment, the first portion 15 of the peripheral wall is impervious, while the second portion 16 of the same is permeable or provided with perforation or with through holes or, as the case may be, with a combination thereof (not shown).

Figure 2:
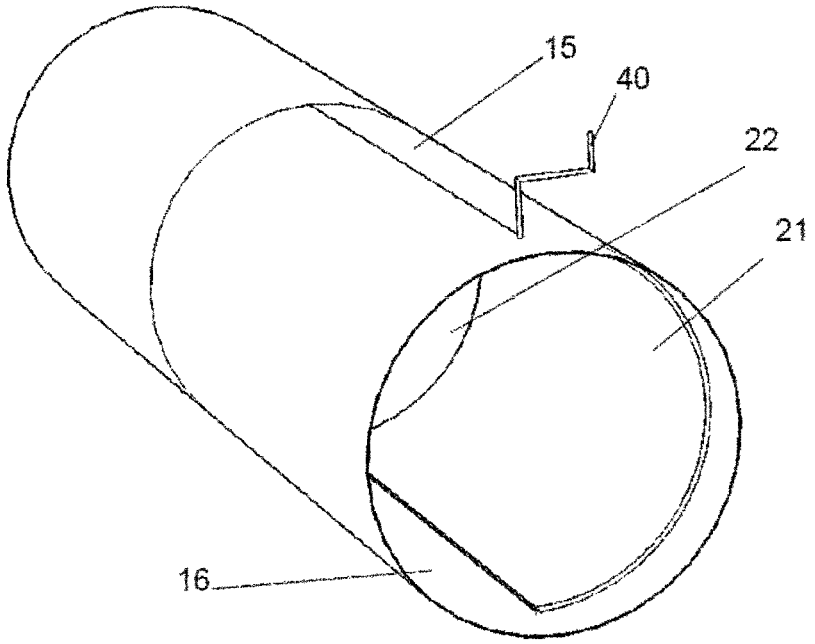
FIG. 2 schematically shows a first exemplary embodiment of the duct according to the invention in a perspective view.

This exemplary embodiment works in the following manner:

After the regulating membrane has been shifted into the position shown in FIGS. 2 and 3, in which position the regulating membrane adjoins the first portion 15 of the peripheral wall and the impervious area 17 of the interior partition, the air flow fed into the inlet of the duct passes through the pervious area 18 of the interior partition in order to be led away into a downstream duct, on the one hand, and through the second portion 16 of the peripheral wall in order to be led away into the ambient atmosphere, on the other hand. Thereby, the conveyance and distribution of air via the aforesaid duct is carried out.

After the regulating membrane has been shifted into the opposite position shown in FIG. 4, in which position the regulating membrane adjoins the second portion 16 of the peripheral wall and the pervious area 18 of the interior partition, the inner walls of the duct are formed by the impervious first portion 15, by the impervious area 17 of the interior partition as well as by the longitudinal 21 and transverse portions 22 of the impervious regulating membrane. Thereby, the duct is completely closed and the air supplied to the inlet end of the duct can flow neither to a downstream duct nor to the atmosphere surrounding the closed duct.

Alternatively, the second portion 16 of the peripheral wall can be impervious, as well. In such case, the duct assuming the position shown in FIGS. 2 and 3 is adapted for conveying air into downstream ducts, the distribution of air into the ambient atmosphere around the given duct being disabled; when assuming the position shown in FIG. 4, this duct is completely closed.

The aforesaid two alternatives are particularly advantageous when incorporated in branched air-conditioning ducts where they serve for closing and opening (enabling) the individual branches of such a duct in a selective manner. For example, an air-conditioning distribution system can comprise a main (backbone) duct and several branch ducts extending from the former, the inlet of at least one of the branch ducts being provided with an interior partition and a regulating membrane according to the embodiment described above, the length of the longitudinal portion 21 of the latter approximately corresponding to the internal diameter of the given branch duct. More generally, the length of the longitudinal portion of the membrane ranges between 0.7 and 2.5-fold of the internal diameter of the branch duct.

According to another alternative embodiment, both the first portion 15 and the second portion 16 are made pervious to air, whether by means of through holes or perforations, or owing to a pervious nature of the fabric used. In such case, the duct serves for conveying and distributing air when assuming the position shown in FIGS. 2 and 3 and for distributing air into the ambient atmosphere when assuming the position shown in FIG. 4; in the latter case, the conveyance of air into downstream ducts being excluded.

According to yet another alternative embodiment, the first portion 15 of the peripheral wall of the duct is pervious while the second portion 16 of the same is impervious to air. When the duct assumes the position shown in FIGS. 2 and 3, it is usable for conveying air into downstream ducts; contrarily, when assuming the position shown in FIG. 4, the duct can be used for distributing air into the ambient atmosphere, the conveyance of air into downstream ducts being excluded.

Figure 5:
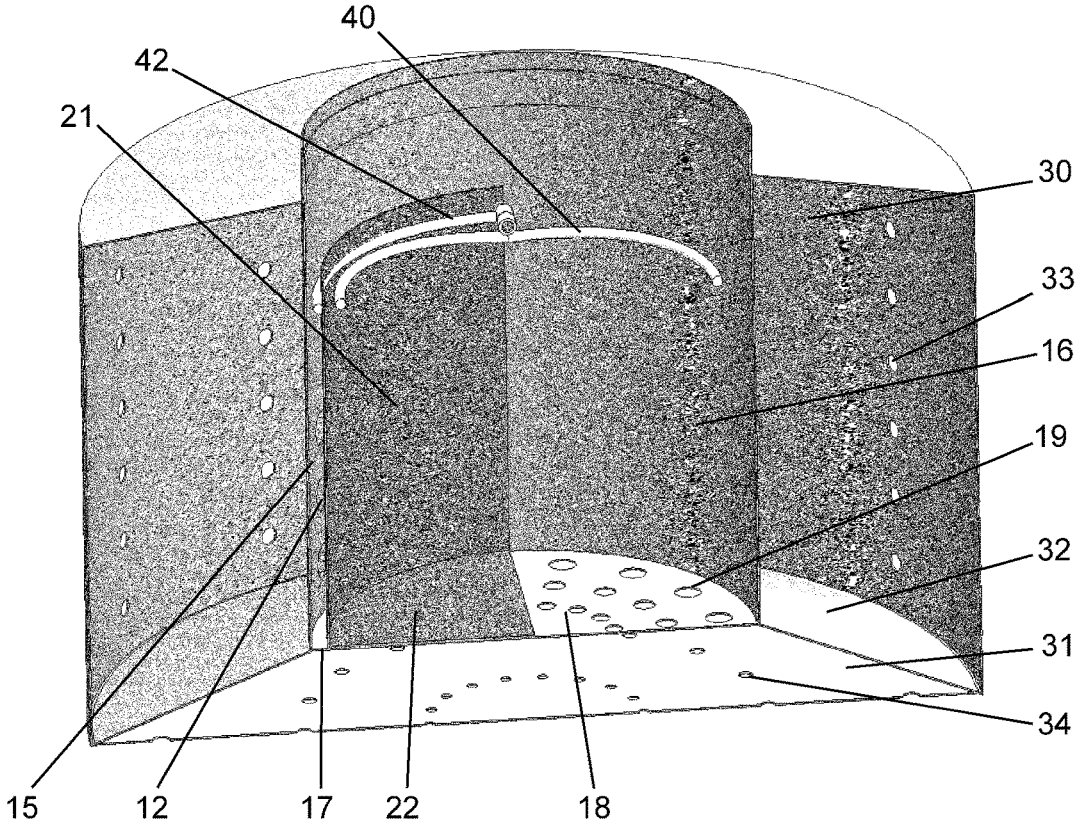
FIG. 5 shows a second exemplary embodiment of the duct according to the invention in a cross-sectional view.

The second exemplary embodiment of the duct comprising a regulating membrane according to the present invention is shown in FIG. 5 by way of an exemplary sectional view. Herein, a duct is concerned that is to be installed in a vertical direction and that is supplied with air fed from above.

Again, this embodiment applies to a duct comprising a peripheral wall, a ducting outlet and an interior partition, the first portion 15 of the peripheral wall being adjoined by the impervious area 17 of the interior partition and the second portion 16 of the peripheral wall being adjoined by the pervious area 18 of the partition. Again, the regulating membrane is secured inside the mutually opposite areas of the peripheral wall and extends along the corresponding flip plane, one end of the regulating membrane being attached to the shifting device 40 and the other end of the same being provided with the transverse portion 22, the latter being attached to the interior partition along the flip plane.

In addition, the end portion of the duct is provided with an outer jacket 30 that surrounds the peripheral wall of the duct spaced apart from the same, said outer jacket extending beyond the end area of the surrounded peripheral wall, and with an outer end wall 31 that is spaced from the interior partition 22 and closes the outer jacket 30. The portion of the peripheral wall of the duct, which is arranged downstream the interior partition, widens in a funnel-like manner and has its largest cross section attached to the outer jacket 30 and/or to the end wall 31.

The outer jacket 30, which is made of a woven or non-woven fabric or of a foil, is provided with an array of through holes and/or perforation and/or it can be made of a pervious fabric. Likewise, the end wall 31, which is also made of a woven or non-woven fabric or of a foil and which is also pervious to air, is provided with an array of through holes and/or perforations and/or made of a pervious fabric.

The first portion 15 of the peripheral wall of the duct, which is adjoined by the impervious area 17, is provided with an array of holes 12, while the second portion 16 of the peripheral wall of the duct remains impervious.

The second embodiment of the invention works in the following manner:

The duct is supplied with air fed from above. When assuming the position shown in FIG. 5 (shifted to the left), the regulating membrane enables the supplied air flow to pass through the holes of the transverse partition into the space between the interior partition and the end wall 31 and to subsequently exit said space downwards, through the holes 34 of the end wall 31. No air is led away in the lateral direction.

Shifting the regulating membrane into the opposite position (to the right, as shown in the drawing) causes the holes 12 of the peripheral wall to become exposed and the holes 19 of the transverse partition to be covered up. The air flow, which is supplied to the duct, exists the same in a lateral direction entering the space between the peripheral wall and the outer jacket 30; therefrom, the air flow is distributed through the holes 33 of the outer jacket 30 in multiple lateral directions.

In an alternative embodiment, the end wall 31 is omitted and the outer jacket is terminated by a radial wall at the level of the partition, the radial wall interconnecting the outer jacket with the peripheral wall of the duct. When the regulating membrane assumes the position shown in FIG. 5, the air flow is routed through the holes 19 of the transverse partition in order to be allowed to exit directly into the surroundings.

In another alternative embodiment, which is shown in FIG. 5, the end wall 31, which is provided with through holes and comprises a funnel-shaped or cylindrical portion attached to the peripheral wall of the duct in the area around the interior partition, remains unchanged but the outer jacket 30 is left out. When the regulating membrane assumes the position shown in FIG. 5, the present alternative embodiment of the duct acts in the same manner as the duct shown in FIG. 5, while when the regulating membrane is shifted in the other position, it causes the air flow to pass through the holes of the first portion 15 of the peripheral wall into the surroundings, not downwards and not into the area adjoining the second portion 16 of the peripheral wall of the duct. The present alternative embodiment can be used, for example, when the duct is arranged in a corner of a room or when the duct adjoins another building element.

Figure 6:
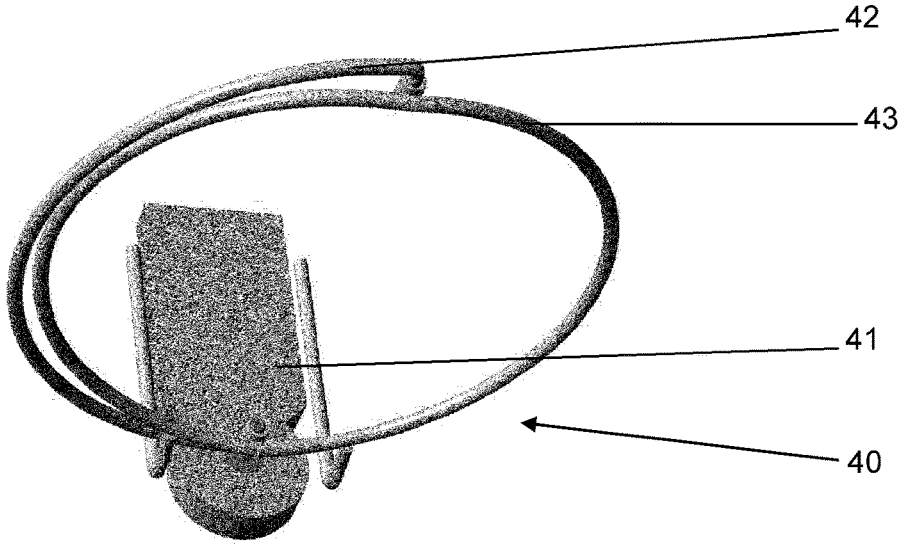
FIG. 6 shows an exemplary embodiment of a shifting device.

FIG. 6 schematically shows an exemplary embodiment of the shifting device 40. In this embodiment, the shifting device comprises an assembly consisting of a carrying annular element 43 and a base element 41, the former being attached to the latter. This assembly supports the shifting element 42 attached thereto; in the present exemplary embodiment, the shifting element consists of a semi-circular hoop having its one end pivotally attached to the carrying annular element 43 and its other end connected to a servomotor (not shown) mounted on the base element 41. This shifting element 42 is interconnected with the longitudinal portion 22 of the regulating membrane, the latter having its end, which faces towards the inlet of the duct, attached (e.g. by stitching) to the former.

Preferably, the end positions of the shifting element 42 delimit a surface area which is equal to or slightly greater than that of the cross section of the peripheral wall of the duct in the given point in order to cause the regulating membrane to tightly adjoin the respective portion 15, 16 of the peripheral wall of the duct. Preferably, the carrying annular element 43 delimits a surface area which is smaller than that delimited by the end positions of the shifting element 42. In this particular exemplary embodiment, the radius of the semi-circular hoop exceeds that of the carrying annular element 43.

It is a matter of course that another type of the shifting device 40 can be also used, such as a manually operated shifting device 40 as indicated in FIG. 2.

The position, in which the shifting device 40 is installed, shall cause the rotational axis thereof to lie in the flip plane, i.e. in that plane which at least partially includes the attachment lines between the regulating membrane and the peripheral wall.

Theoretically, a duct having a square cross section can be provided, in which duct the respective regulating membrane would be shiftable without any pivoting action of a reinforcing hoop under the condition that the regulating membrane is attached to the duct in diagonally opposite corners and that, e.g., a clamping linkage is used, the latter having its inlet end attached to the midpoint of the end face of the longitudinal portion 21 of the regulating membrane. The shifting movement of the regulating membrane is derived from a simple translational movement of the clamping mechanism along a diagonal path between the corner positions of the same. Thereby, the regulating membrane can be shifted to the respective portion of the peripheral wall (or portions of a pair of peripheral walls) in a relatively tight manner.

Figure 7:
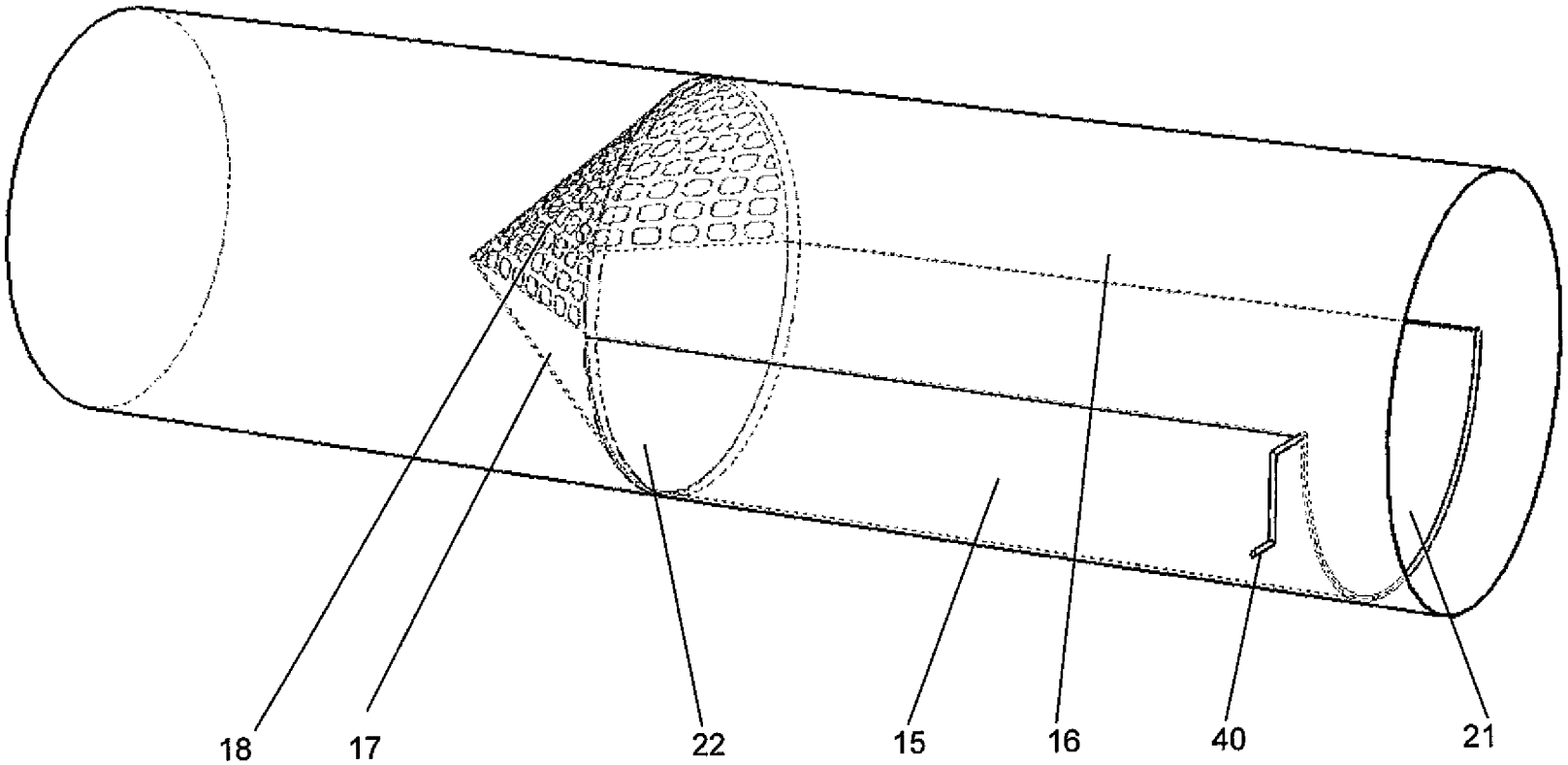
FIG. 7 shows another alternative embodiment of the invention.

In a further alternative embodiment, which is shown in FIG. 7, the interior partition has a conical shape or, in other words, comprises the impervious area 17 having a semi-conical shape and the pervious area 18 having a complementary semi-conical shape. Again, the transverse portion 22 of the regulating membrane has a shape corresponding to that of the impervious area 17 of the interior partition, i.e., a semi-conical shape.

Figure 8:
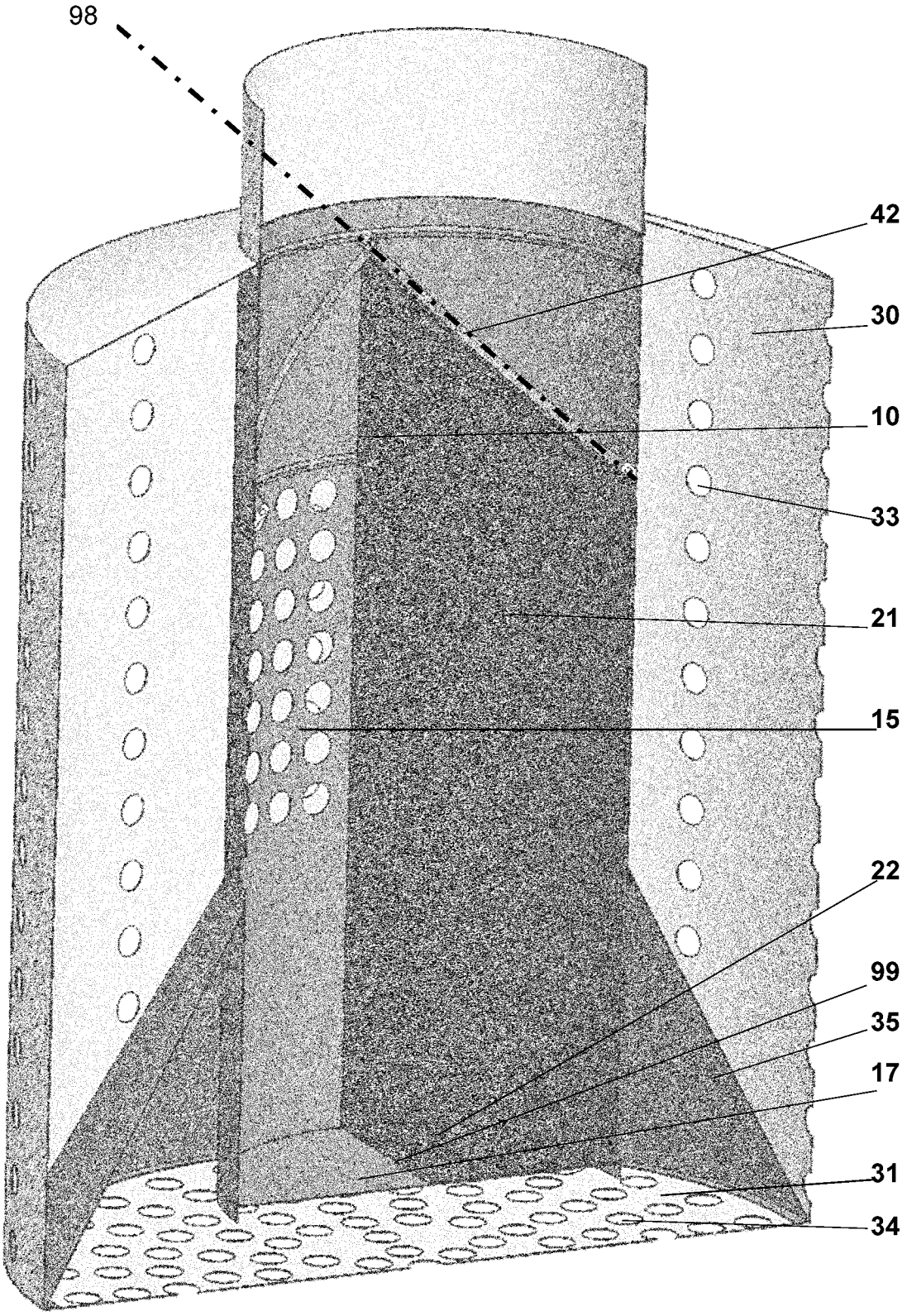
FIG. 8 schematically shows another embodiment of the duct according to the invention in a sectional view, the duct being vertically suspended and having the regulating membrane in a position enabling air to be distributed in lateral directions.
Figure 9:
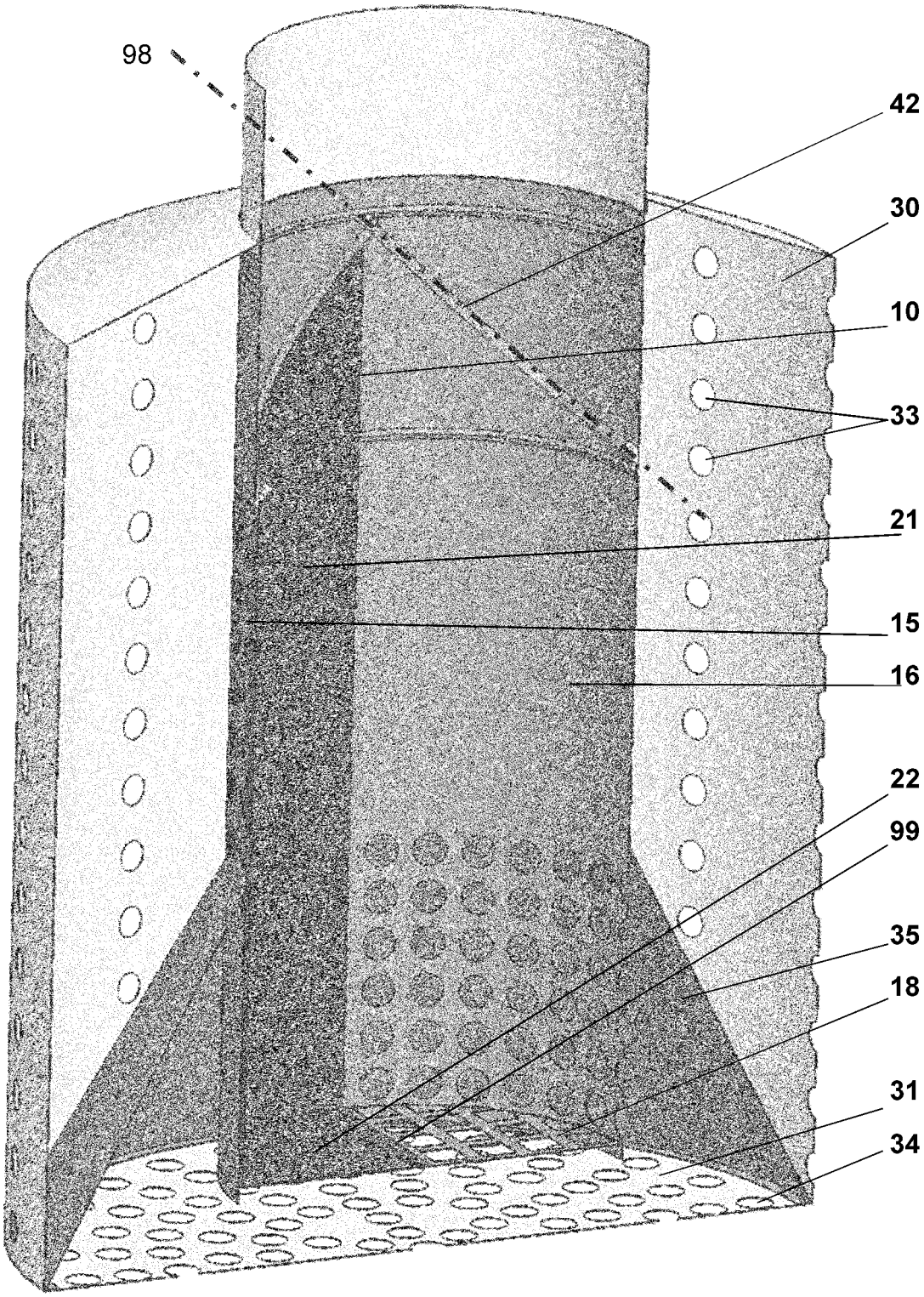
FIG. 9 shows the duct of FIG. 8, the regulating membrane being shifted in a position enabling air to be distributed in a downward direction.

In another embodiment, which is shown in FIGS. 8 and 9, the shifting element 42 has a shape corresponding to one half of the circumference of an oblique section through the air-conditioning duct, said section more preferably extending along a plane 98 forming an angle of approximately 45° with the longitudinal axis of the duct.

Thus, the shifting element 42 has a shape corresponding to one half of the circumference of an ellipse when it forms a part of an air-conditioning duct having a circular cross-section. In case of an air-conditioning duct having a rectangular cross-section, the shifting element 42 has a shape corresponding to one half of the circumference of a rectangle.

The shifting device can comprise a manually operated actuator or a servomotor (not shown) enabling the shifting action to be carried out in a motorized manner.

In general, the shifting element 42 according to the exemplary embodiments shown in FIGS. 8 and 9 should have a shape that makes it possible to shift said element both to the first portion 15 and to the second portion 16 of the peripheral wall of the respective air-conditioning duct, either shifted position enabling the circumference of the element to adjoin said wall of the air-conditioning duct being achievable by turning the shifting element at an angle ranging between 80 and 110°, preferably at the angle of 90°.

This implies that the shifting element 42 should have a shape corresponding to one half of the circumference of an oblique section through the air-conditioning duct, said section extending along a plane forming an angle, which is equal to one half of the turning angle of the shifting element, with the longitudinal axis of the duct, said turning angle being that between the end positions of the shifting element.

Ducts according to the embodiment shown in FIGS. 8 and 9 are installed in a vertical direction and supplied with air fed from above, similarly to the embodiment shown in FIG. 5. In this exemplary embodiment, the air-conditioning duct comprises a peripheral wall which includes a first portion 15 surrounding the respective first cross-sectional area and a second portion 16 surrounding the respective second cross-sectional area, the first portion 15 and the second portion 16 of the peripheral wall being mirror images of each other, the axis of symmetry thereof being defined by a flip plane extending in the lengthwise direction through the longitudinal centre line of the air-conditioning duct.

The duct comprises a transverse interior partition arranged therein, the partition having an impervious area 17 and a pervious area 18 allowing air to flow through it, the transition line between the impervious area 17 and the pervious area 18 of the interior partition extending substantially through the flip plane mentioned above.

In this exemplary embodiment, the pervious area 18 of the interior partition is provided with through holes. Nevertheless, it is possible to provide an interior partition, which comprises merely the impervious area 17, while the remaining part of the inside cross section of the corresponding duct remains entirely free. In other words, it is possible to create an impervious interior partition that protrudes merely into a certain part of the inside cross section of the duct, the remaining part of that cross section being left free. Alternatively, the pervious area 18 can be created from a pervious or perforated fabric or from a perforated foil.

The duct also comprises a regulating membrane arranged inside the same, said membrane consisting of a longitudinal portion 21 and a transverse portion 22.

The longitudinal portion 21 of the regulating membrane is sewed into the duct along the borders between the first portion 15 and the second portion 16 of the peripheral wall of the duct or along an attachment line 10 defining the intersection between the above mentioned flip plane and the peripheral wall. In this exemplary embodiment, the longitudinal portion 21 of the regulating membrane is rectangular in shape and can be selectively shifted to, or preferably pushed against the first portion 15 (FIG. 9) or the second portion 16 (FIG. 8) of the peripheral wall when being subject to the action of flowing air.

In the vicinity of the inlet end of the duct, the longitudinal portion 21 is attached to the shifting element 42 for shifting the regulating membrane to the first portion 15 or the second portion 16 of the peripheral wall.

The opposite end of the longitudinal portion 21 is connected to the transverse portion 22 of the regulating membrane, the transverse portion 22 having a shape that substantially corresponds to that of the impervious area 17 and/or to that of the pervious area 18 of the interior partition. Simultaneously, the transverse portion 22 of the regulating membrane is attached to/stitched on the interior partition along an attachment line 99 located between the impervious area 17 and the pervious area 18 of the same.

In other words, the regulating membrane forms an interior wall inside the duct, the longitudinal portion 21 of said interior wall being adapted for adjoining the first portion 15 or the second portion 16 of the peripheral wall in a selective manner and the transverse portion 22 of said interior wall being adapted, contrarily to the longitudinal one, for adjoining the impervious area 17 or the pervious area 18.

In addition, the end portion of the duct is provided with an outer jacket 30 that surrounds the peripheral wall of the duct without being in contact with the same, said outer jacket extending beyond the end area of the surrounded peripheral wall, and with an outer end wall 31 that is spaced from the interior partition 22 and encloses the outer jacket 30.

Furthermore, the space between the peripheral wall of the duct and the outer jacket 30 is divided into two partial rooms by a funnel-shaped wall 35 having its narrower end attached to the peripheral wall of the duct and its wider end attached to the outer jacket 30 and/or to the outer end wall 31.

The outer jacket 30, which is made of a woven or non-woven fabric or of a foil, is provided with an array of through holes and/or perforations; and/or it can be made of a pervious fabric. Likewise, the end wall 31, which is also made of a woven or non-woven fabric or of a foil and which is also pervious to air, is provided with an array of through holes and/or perforations and/or made of a pervious fabric.

The area of the first portion 15 of the peripheral wall of the duct, where said first portion immediately adjoins the outer jacket 30, is provided with an array of holes, while the area, where the same is separated from the outer jacket by the funnel-shaped wall 35, on the one hand, and adjoined by the impervious area 17 of the interior partition, on the other hand, is impermeable. The area of the second portion 16 of the peripheral wall of the duct, where said second portion immediately adjoins the outer jacket 30, is impermeable, while the area, where the same is separated from the outer jacket 30, is pervious to air or provided with through holes.

The present embodiment of the invention works in the following manner:

The duct is supplied with air fed from above. When assuming the position shown in FIG. 8 (shifted to the right), the regulating membrane enables the air flow supplied to the duct to pass through the holes of the first portion 15 and to exit the same in a lateral direction in order to subsequently enter the space between the peripheral wall and the outer jacket 30; therefrom, the air flow is then distributed through the holes 33 of the outer jacket 30 in multiple lateral directions.

Shifting the regulating membrane 1 into the opposite position shown in FIG. 9 (to the left, as indicated in the drawing) causes both the holes of the interior partition and those of the second portion 16 of the peripheral wall of the duct to be uncovered. The supplied air flow passes through the holes of the transverse partition and through those of the second portion 16 of the peripheral wall into the space confined between the interior partition, the funnel-shaped wall 35 and the end wall 31 in order to subsequently exit that space through the holes 34 of the end wall 31 in a downward direction. No air is led away in the lateral direction.

In an alternative embodiment, the end wall 31 is omitted and the outer jacket is terminated by a radial wall in the level of the partition, the radial wall interconnecting the outer jacket with the peripheral wall of the duct. When the regulating membrane assumes the position shown in FIG. 9, the air flow is routed through the holes of the transverse partition and through those of the second portion 16 of the peripheral wall (when the latter are present) in order to be allowed to exit directly to the ambient atmosphere.

In another embodiment, which is an alternative to that shown in FIGS. 8 and 9, the end wall 31 provided with through holes and the funnel-shaped wall 35 remain unchanged but the outer jacket 30 is left out. When the regulating membrane assumes the position shown in FIG. 9, the present alternative embodiment of the duct acts in the same manner as the duct shown in FIG. 9, while the shifted position of the regulating membrane causes the air flow to pass through the holes of the first portion 15 of the peripheral wall into the ambient atmosphere, rather than into the area adjoining the second portion 16 of the peripheral wall of the duct. The present alternative embodiment can be used, for example, when the duct is arranged in a corner of a room or when the duct adjoins another building element.

All the above exemplary embodiments of the invention provide a regulating membrane that comprises a longitudinal portion 21 having a rectangular cross section, the surface area of said cross section substantially corresponding to one half of the cross-sectional surface area of the duct, and a transverse portion 22 having a shape that substantially corresponds to one half of the inside cross section of the duct. Nevertheless, a regulating membrane comprising merely a longitudinal portion 21 is also conceivable, wherein said longitudinal portion has a width, which substantially corresponds to one half of the circumference of the inside cross section of the duct. The end of said longitudinal portion, which faces away from the inlet of the duct, forms pleats and is stitched to the interior partition in the area of said pleats, the individual stitches being arranged along a line forming an extension of the attachment line between the regulating membrane and the peripheral wall/walls of the duct. Alternatively, the regulating membrane comprising merely the longitudinal portion 21 can have a width which is equal to that of the cross section of the duct in the area, where the regulating membrane is attached to the interior partition; nevertheless, this width gradually increases towards the inlet end of the duct and becomes substantially equal to one half of the circumference of the inside cross section of the duct in the area where the regulating membrane is attached to the shifting device.

It is obviously advantageous when the connections between the regulating membrane and the peripheral wall of the duct, between the regulating membrane and the interior partition, as well as between the impervious area of the interior partition and the peripheral wall of the duct, or, as the case may be, between the longitudinal and transverse portions 21, 22 of the regulating membrane are impervious, which can be achieved by means of various sewing or gluing techniques, such techniques being generally known in the art.

The impervious area of the duct according to the invention can be made, for example, of a woven fabric consisting of endless fibres and provided with a bonding coat, particularly with a PU, PVC or silicone coat. The application of such a bonding coat will also enable to obtain the desired impervious properties of the joints between the individual portions.

The position, in which the shifting device is installed, causes the rotational axis of the shifting element 42 to lie in the flip plane, i.e. in that plane which at least partially includes the attachment lines between the regulating membrane and the peripheral wall.

Preferably, the regulating membrane is secured to the shifting element 42 in a detachable manner. For example, the end portion of the regulating membrane can be provided with a narrow channel through which the shifting element 42 can be inserted. In order to avoid the necessity of disconnecting the shifting element 42 from the remainder of the shifting device when the shifting element is to be inserted through the narrow channel, the narrow channel can be provided with hook-and-loop closures (e.g., Velcro®) so that the regulating membrane can surround the shifting element 42 after having been attached thereto, the connection between the regulating membrane and the shifting element being fastened by said hook-and-loop closures.

Even though all the above embodiments relate to a duct having a circular cross section, it is obvious that the present invention can likewise apply to ducts having different cross-sectional shapes, such as square, rectangular, oval ones or the like. Generally, the only prerequisite consists in that the first portion 15 and the second portion 16 of the peripheral wall of the duct are mutually mirror-symmetric along the respective flip plane, such symmetry being maintained at least in an area adjoining the shifting element 42 where the latter assumes its end positions. Though advantageous, such mirror symmetry does not necessarily need to be maintained in a greater distance from the shifting device.

Figure 10:
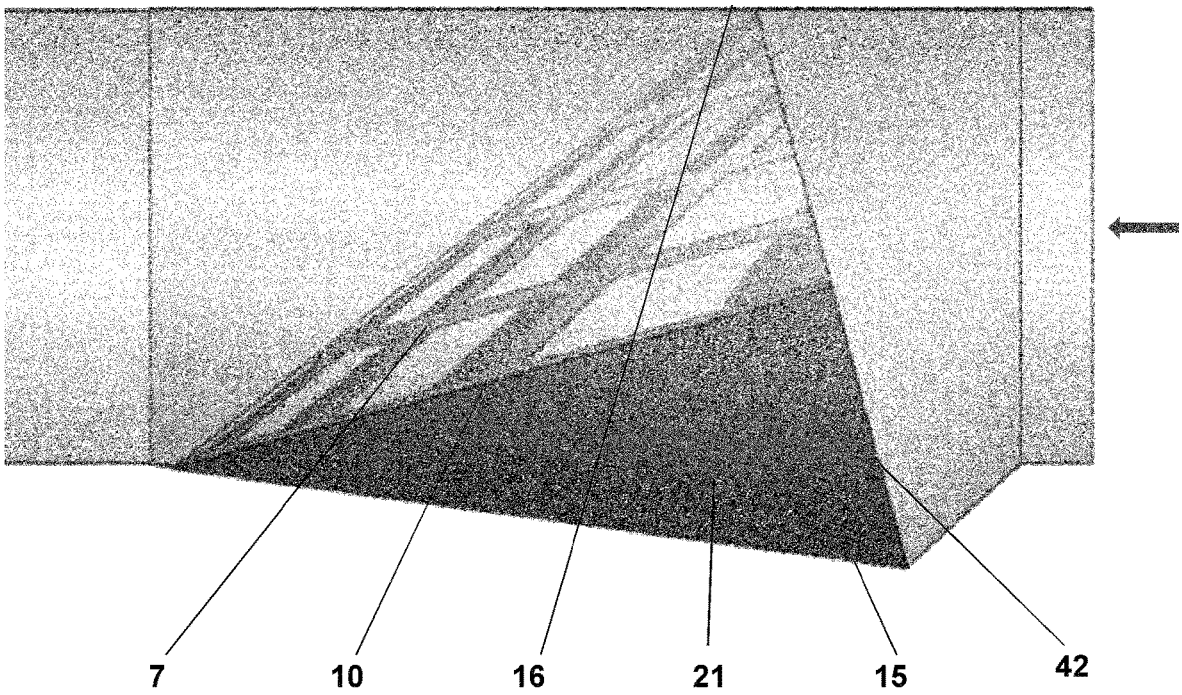
FIG. 10 shows a further embodiment of the invention.

FIG. 10 shows another alternative embodiment of the invention, wherein the peripheral wall of the duct is represented as being transparent, for the sake of clarity. This embodiment is intended for conveying air and is sealable by the regulating membrane. The walls of this air-conditioning duct are—at least along a certain lengthwise portion thereof—impervious.

The air-conditioning duct comprises funnel-like widened portions arranged in the area, where the shifting element is mounted, and in the respective adjacent areas, the widest cross-section of the air-conditioning duct being situated exactly in said mounting area of the shifting element or in an area where the shifting element 42 assumes one of its end positions. Again, the shape of the shifting element 42 corresponds to that of one half of the circumference of an oblique section through the duct, particularly to that of a section extending along a plane in which the rotational axis of the shifting element 42 lies.

Preferably, the widened cross section of the duct is arranged in an area corresponding to the first portion 15 of the peripheral wall of the duct or, as the case may be, in an area where the regulating membrane adjoins the peripheral wall of the duct when the latter is in an open state.

The regulating membrane has its end, which faces towards the inlet end of the duct, attached to the shifting element 42. According to the embodiment shown in the drawing, the regulating membrane is attached to the wall of the duct along the line 10 and shifted to the first portion 15 of that wall. In this embodiment, the supporting element 7, which is also attached to the wall of the duct along the line 10, is formed by a supporting wire gauze. When the regulating membrane or either end thereof is shifted to the second portion 16 of the peripheral wall of the duct, the supporting element is able to support the regulating membrane, thus preventing the latter to be damaged by the air pressure.

After shifting the shifting element 42 along with the related end of the regulating membrane to the second portion 16 of the peripheral wall of the duct, the air flow is prevented from passing through the duct which means that the latter is closed. After shifting the shifting element 42 along with the regulating membrane to the first portion 15 of the peripheral wall of the duct, the air flow is enabled to pass through the open duct into downstream ducting assemblies.

An advantage of the present embodiment consists in that the duct can be closed by means of the regulating membrane in a manner which ensures that neither said regulating membrane nor another partial obstruction unacceptably restricts the cross section of the duct and the air flow after the duct has been opened. If the duct were not provided with a widened portion arranged in the given area, the pressure of air entrapped between the first portion 15 of the wall of the duct and the regulating membrane could cause the regulating membrane to bulge out into the inner space of the duct and to locally restrict the free cross section of the latter which would subsequently reduce the pressure acting in the downstream ducting branches.

According to the embodiment of the shifting device with the oblique shifting element 42 shown in FIG. 10, the shifting element must be turned by 180° between its end positions. Nevertheless, a yet another arrangement of the shifting device is conceivable, which arrangement would enable said shifting device to be shifted from one end position to the other one, i.e. the respective end of the regulating membrane to be shifted to the first portion 15 or to the second portion 16 of the wall of the duct by turning the same by not more than 90°, as shown in FIGS. 8 and 9. This requires the attachment line of the regulating membrane as well as the location and shape of the shifting element 42 to be appropriately defined with respect to the shape of the wall of the duct, which means that the shifting element 42 should adjoin the first portion 15 of the wall of the duct along its own circumference when assuming one end position and the second portion 16 of the wall of the duct along its own circumference when assuming the other end position.

The preferred embodiments described above apply to air-conditioning ducts made of a woven or non-woven fabric or of a foil, i.e., of a washable material. Nevertheless, a combination comprising a regulating membrane made of an impervious fabric or foil and an interior partition may be also used for ducts having their peripheral wall made of a sheet metal or, as the case may be, of another inflexible material.

Although multiple exemplary embodiments are described above, it is obvious that those skilled in the art would easily appreciate further possible alternatives to those embodiments. Hence, the scope of the present invention is not limited by the above exemplary embodiments and is rather defined by the appended claims.

The invention claimed is:

1. An air-conditioning duct for conveying and/or distributing air, comprising:

a peripheral wall divided into a first portion and a second portion, the first and second portions having at least one common border extending in a longitudinal direction of the air-conditioning duct, an inlet for supplying air, a regulating membrane made of air impermeable woven or non-woven fabric or of a foil, the regulating membrane comprising a longitudinal portion arranged inside the air-conditioning duct and attached to the peripheral wall of the air-conditioning duct along at least one attachment line extending along the at least one common border between the first portion and the second portion, wherein the regulating membrane has a first end facing the inlet for supplying air and at least an area of the regulating membrane comprising said first end is adapted for being selectively shifted to the first portion or the second portion of the peripheral wall of the air-conditioning duct, and a shifting element for shifting the first end of the regulating membrane to the first portion or the second portion of the peripheral wall of the air-conditioning duct, the regulating membrane having its first end attached to the shifting element, wherein the regulating membrane has a second end, which faces away from the inlet of the air-conditioning duct, secured inside the air-conditioning duct in a manner which ensures that shifting of at least the area of the first end of the regulating membrane to the second portion of the peripheral wall of the air-conditioning duct prevents the air flow from passing through the air-conditioning duct which is situated downstream of the attached second end of the regulating membrane with respect to the direction of that air flow.

2. The air-conditioning duct according to claim 1, wherein the shifting element is pivotable between a first end position and second end position, the shifting element being shaped to correspond to the air-conditioning duct when the shifting element is in either the first end position or the second end position, and wherein, when in the first end position or the second end position, the shifting element lies in a plane angled between 30 and 80° from a longitudinal axis of the air-conditioning duct.

3. The air-conditioning duct according to claim 1, wherein the shifting element for shifting the regulating membrane to the first portion or second portion of the peripheral wall of the air-conditioning duct is arranged inside the air-conditioning duct in a manner allowing the shifting element to be turned at an angle ranging between 70 and 120°.

4. The air-conditioning duct according to claim 1, wherein the shifting element is pivotable between a first end position and second end position, the shifting element being shaped to correspond to the air-conditioning duct when the shifting element is in either the first end position or the second end position, the shifting element sweeping through a turning angle when moved between the first end position and the second end position, and wherein, when in the first end position or the second end position, the shifting element lies in a plane forming a second angle from a longitudinal axis of the air-conditioning duct, the second angle being one half of the turning angle.

5. The air-conditioning duct according to claim 1, further comprising:

an interior partition made of a woven or non-woven fabric or of a foil and attached to the peripheral wall of the air-conditioning duct, thereby partitioning at least a part of an inner space of the air-conditioning duct, the second end of the regulating membrane being attached to the interior partition along a second attachment line, a first area of the interior partition confined between the regulating membrane and the first portion of the peripheral wall being air impervious and a second area of the interior partition between the regulating membrane and the second portion of the peripheral wall of the air-conditioning duct at the level of the interior partition being adapted for allowing air to flow therethrough.

6. The air-conditioning duct according to claim 5, wherein the second attachment line extends along an interface between the first area and the second area of the interior partition.

7. The air-conditioning duct according to claim 6, wherein the first portion of the peripheral wall is pervious and/or provided with a perforation and/or with through holes and that the regulating membrane overlaps also the impervious area of the interior partition when assuming a position for overlapping the first portion of the peripheral wall.

8. The air-conditioning duct according to claim 7, further comprising an outer jacket that surrounds the peripheral wall of at least a part of the air-conditioning duct, while being spaced apart from said peripheral wall and forming a chamber into which the holes of the first portion of the peripheral wall open, the outer jacket being provided with holes for distributing air into the surroundings.

9. The air-conditioning duct according to claim 8, further comprising an end wall that is attached to an end of the air-conditioning duct facing away from the inlet, the end wall extending along the interior partition spaced apart therefrom and being at least one of pervious, perforated, or provided with through holes.

10. The air-conditioning duct according to claim 9, further comprising a funnel-shaped wall having its narrower end attached to the peripheral wall and its wider end attached to the end wall and/or to the outer jacket, the funnel-shaped wall dividing the space extending between the outer jacket and the peripheral wall of the air-conditioning duct into a first partial space, into which the holes of the first portion of the peripheral wall open, and a second partial space, into which the air outlet for the air passing through the pervious area of the interior partition opens.

11. The air-conditioning duct according to claim 5, wherein the regulating membrane further comprises a transverse portion having a shape that corresponds to one half of the inside cross section of the air-conditioning duct, the regulating membrane being attached to the impervious area of the interior partition via said transverse portion.

12. The air-conditioning duct according to claim 2, further comprising a widened portion adjoining at least one of the first or second end positions of the shifting element as well as at least one further, adjacent widened portion.

13. The air-conditioning duct according to claim 12, further comprising a supporting element secured to the wall of the air-conditioning duct along the at least one attachment line of the regulating membrane, said supporting element being adapted to support the regulating membrane when the regulating membrane assumes a position with its first end and the shifting element shifted to the second portion of the peripheral wall.

14. The air-conditioning duct according to claim 1, wherein the shifting device further comprises a servomotor for setting the position of the shifting element.

15. The air-conditioning duct according to claim 3, wherein the angle is 90°.

16. An air-conditioning duct for conveying and/or distributing air, comprising:

a peripheral wall divided into a first portion and a second portion, the first and second portions having at least one common border, the first portion having a wide end being upstream and a narrow end being downstream;

an inlet for supplying air;

a regulating membrane made of air impermeable woven or non-woven fabric or of a foil, the regulating membrane comprising a longitudinal portion arranged inside the air-conditioning duct and attached to the peripheral wall of the air-conditioning duct along at least one attachment line extending along the at least one common border between the first portion and the second portion, wherein the regulating membrane has a first end facing the inlet for supplying air and at least an area of the regulating membrane comprising said first end is adapted for being selectively shifted to the first portion or the second portion of the peripheral wall of the air-conditioning duct; and a shifting element for shifting the first end of the regulating membrane to the first portion or the second portion of the peripheral wall of the air-conditioning duct, the regulating membrane having its first end attached to the shifting element;

wherein the regulating membrane has a second end, which faces away from the inlet of the air-conditioning duct, secured inside the air-conditioning duct in a manner which ensures that shifting of at least the area of the first end of the regulating membrane to the second portion of the peripheral wall of the air-conditioning duct prevents the air flow from passing through the air-conditioning duct which is situated downstream of the attached second end of the regulating membrane with respect to the direction of that air flow.

* * * * *